US010029873B2

(12) United States Patent
Ikeda et al.

(10) Patent No.: US 10,029,873 B2
(45) Date of Patent: Jul. 24, 2018

(54) APPARATUS FOR CONTROLLING CONVEYANCE BETWEEN ROLLERS

(71) Applicant: MITSUBISHI ELECTRIC CORPORATION, Chiyoda-ku (JP)

(72) Inventors: Hidetoshi Ikeda, Tokyo (JP); Masaya Kimura, Tokyo (JP); Akio Saito, Tokyo (JP); Yoshihiro Marushita, Tokyo (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 274 days.

(21) Appl. No.: 15/104,900

(22) PCT Filed: Nov. 17, 2014

(86) PCT No.: PCT/JP2014/080372
§ 371 (c)(1),
(2) Date: Jun. 15, 2016

(87) PCT Pub. No.: WO2015/093211
PCT Pub. Date: Jun. 25, 2015

(65) Prior Publication Data

US 2016/0318726 A1 Nov. 3, 2016

(30) Foreign Application Priority Data

Dec. 17, 2013 (JP) ..... 2013-260150

(51) Int. Cl.
*G05B 13/02* (2006.01)
*B65H 18/14* (2006.01)
(Continued)

(52) U.S. Cl.
CPC ..... *B65H 18/145* (2013.01); *B65H 23/044* (2013.01); *B65H 23/1806* (2013.01);
(Continued)

(58) Field of Classification Search
CPC ..... B65H 18/145; B65H 23/044; B65H 23/1806; B65H 23/1888; G05B 13/02
See application file for complete search history.

(56) References Cited

U.S. PATENT DOCUMENTS 4,159,808 A * 7/1979 Meihofer ..... B65H 23/1955 242/413.1
6,068,206 A * 5/2000 Lindsay, Jr. ..... B65H 23/1806 242/334.2
(Continued)

FOREIGN PATENT DOCUMENTS

JP 62-063301 A 3/1987
JP 63-035102 A 3/1988
(Continued)

OTHER PUBLICATIONS

International Search Report dated Feb. 24, 2015 for PCT/JP2014/080372 filed on Nov. 17, 2014.
Combined Office Action and Search Report dated Jun. 27, 2016 in Taiwanese Patent Application No. 103142557 (with partial English translation and English translation of categories of cited documents).

*Primary Examiner* — Sang K Kim
(74) *Attorney, Agent, or Firm* — Oblon, McClelland, Maier & Neustadt, L.L.P.

(57) ABSTRACT

An apparatus for controlling conveyance between rollers includes: a tension-control-amount-detector; a speed-shaft-speed-controller; a tension-shaft-speed-controller; a synchronous-speed-command-generation-unit synchronizing the speed-shaft speed command with a tension-shaft reference speed command; a tension-control-calculation-unit outputting a tension-control correction value based on proportional compensation based on a proportional gain, and integral compensation based on an integral gain; an adjustment-execution-command-generation-unit outputting an
(Continued)

adjustment execution command during an automatic adjustment period; a binary-output-unit outputting one of positive and negative values of the additional-value amplitude as an additional value in adjustment during the automatic adjustment period; a tension-shaft-speed-command-generation-unit outputting a tension-shaft speed command based on the tension-shaft reference speed command, the tension-control correction value and the additional value in adjustment; and a gain-calculation-unit calculating a proportional gain and an integral gain based on a period and an amplitude of the tension control deviation for the automatic adjustment period.

3 Claims, 9 Drawing Sheets

(51) Int. Cl.
*B65H 23/18* (2006.01)
*B65H 23/04* (2006.01)
*B65H 23/188* (2006.01)

(52) U.S. Cl.
CPC ..... *B65H 23/1888* (2013.01); *B65H 2513/11* (2013.01); *B65H 2515/31* (2013.01); *B65H 2515/312* (2013.01); *B65H 2557/264* (2013.01); *B65H 2557/2644* (2013.01)

(56) References Cited

U.S. PATENT DOCUMENTS

| | | | | |
|---|---|---|---|---|
| 9,676,578 | B2 * | 6/2017 | Onodera | B65H 23/1806 |
| 2002/0117573 | A1 * | 8/2002 | Nakata | B65H 18/08 242/412 |
| 2004/0173708 | A1 * | 9/2004 | Neumann | B65H 18/103 242/412.3 |
| 2012/0138726 | A1 * | 6/2012 | Liu | B65H 23/1813 242/420.5 |
| 2016/0340140 | A1 * | 11/2016 | Onodera | B65H 23/1806 |
| 2017/0174461 | A1 * | 6/2017 | Kimura | B65H 23/1806 |
| 2017/0267481 | A1 * | 9/2017 | Onodera | B65H 23/1806 |

FOREIGN PATENT DOCUMENTS

| | | | |
|---|---|---|---|
| JP | 07-196216 | A | 8/1995 |
| JP | 08-059042 | A | 3/1996 |
| JP | 09-110251 | A | 4/1997 |
| JP | 10-250888 | A | 9/1998 |

* cited by examiner

APPARATUS FOR CONTROLLING CONVEYANCE BETWEEN ROLLERS

FIELD

The present invention relates to an apparatus for controlling conveyance between rollers, which conveys a belt-like or linear conveyed material that is made from a material such as metal, resin or paper, between rollers that are respectively driven by a plurality of motors, while holding tension of the conveyed material.

BACKGROUND

In a conventional apparatus for controlling conveyance between rollers, as described in Patent Literature 1, in order to convey a conveyed material between two rollers with applying stable and preset tension to the conveyed material, a speed controller for controlling a roller rotation speed for each roller is provided, and a speed command corresponding to a line speed is provided to each speed controller. Simultaneously therewith, tension of the conveyed material between the two rollers is detected by a tension control-amount detector, and an operation is made by a tension controller that executes PI (Proportional-Integrals control or PID (Proportional-Integral-Derivative) control so that a tension detection value matches a tension set value, thereby correcting the speed command with respect to a tension shaft, that is an axis of one of the two rollers based on an output of the tension controller.

In order that the apparatus for controlling conveyance between rollers; mentioned above stably conveys the conveyed material, tension control needs to be executed stably, and a gain of the tension controller needs to be set appropriately. In a typical apparatus for controlling conveyance between rollers, an operator observes tension fluctuation while performing conveyance between the rollers, and changes the control gain by trial and error. Therefore, there is a problem that a lot of labor or time is required for adjustment, and further, performance of stability differs depending on the level of skill of the operator.

Regarding this problem, in a technique described in Patent Literature 1, a model identification unit is provided to identify a control object model of a tension control system. An optimum value of a control gain is found using a genetic algorithm while repeating simulation and evaluation of responses at the time of changing the control gain to a candidate value using the control object model, thereby automatically performing adjustment of the control gain of a tension-control calculation unit.

CITATION LIST

Patent Literature

Patent Literature 1: Japanese Patent Application Laid-open No. H10-250888

SUMMARY

Technical Problem

In such an apparatus for controlling conveyance between rollers, if a gain of the tension-control calculation unit is not set to a sufficiently appropriate value, conveyance between rollers is often unable to be performed under conveyance conditions of a desired speed or acceleration/deceleration.

Meanwhile, in a typical apparatus for controlling conveyance between rollers in which an operator makes adjustment of a control gain of a tension-control calculation unit by trial and error, the operator observes tension fluctuation thereby to adjust the control gain by trial and error while performing a conveyance operation of a conveyed material between rollers.

Therefore, at an initial stage of the adjustment, the gain of the tension-control calculation unit is adjusted so that stable conveyance operation can be performed while the tension fluctuation is being observed under an operation condition different from that of a normal operation, such as a moderate acceleration or deceleration condition or a low speed condition. Further, a response in a tension detection value is checked with bringing the operation condition close to that of the normal operation, and then the control gain of the tension-control calculation unit is adjusted so that the tension is more stabilized. This operation needs to be repeated. That is, it is required to repeat both the change of the operation condition and the change of the control gain by trial and error, for adjusting the control gain of the tension-control calculation unit of the apparatus for controlling conveyance between rollers, and for this reason, a very long time or a lot of labor is necessary.

Furthermore, even if the technique described in Patent Literature 1 is used, it is required to perform identification of a control object of the tension control system, and a seeking operation including response simulation at the time of changing the control gain and optimization of the control gain, while performing a conveyance operation between the rollers. For this reason, such a procedure is required as to start adjustment under a more moderate operation condition different from that of a normal operation, and subsequently change the operation condition gradually.

In addition, because an optimum value of the control gain is sought, while repeating the response simulation at the time of changing the control gain, a long time is required for determination of the control gain. Further, a software to perform accurate identification of a control object, response simulation, or seeking using a genetic algorithm must be constructed, and so there has been a problem in that, a difficult case may be caused from the technical viewpoint or the viewpoint of computer cost.

The present invention has been achieved in view of the circumstances as mentioned above, and an object of the present invention is to provide an apparatus for controlling conveyance between rollers, that, in conveyance between rollers, can set a gain of a tension-control, calculation unit to an appropriate value in a short time, and enables a user to easily realize control of conveying a conveyed material between rollers while maintaining tension at a desired value, regardless of a situation of presetting of the control gain of the tension-control calculation unit, under various conditions such as conveyance speeds, without inconvenience of trial and error and without requiring knowledge based on experiences.

Solution to Problem

In order to solve the aforementioned problems and achieve the object, the present invention provides an apparatus for controlling conveyance between rollers that conveys a conveyed material using a speed shaft roller driven by a speed shaft motor and a tension shaft, roller-driven by a tension shaft motor while applying tension to the conveyed material between the speed shaft roller and the tension shaft roller, the apparatus comprising: a tension control-amount detector to detect and output a tension control amount that is a variable that changes according to tension fluctuation of the conveyed material and is controlled so as to become a desired value; a speed-shaft speed controller to execute control on the speed shaft motor so that a speed at which the speed shaft, roller conveys the conveyed material is equal to a speed of a speed-shaft speed command; a tension-shaft speed controller to execute control on the tension shaft motor so that a speed at which the tension shaft roller conveys the conveyed material is equal to a speed of a tension-shaft speed command; a synchronous-speed-command generation, unit to generate the speed-shaft speed command and a tension-shaft reference speed command that is to be a reference of the tension-shaft speed command in synchronization with each other in change; a tension-control calculation unit to output a tension-control correction value based on proportional compensation obtained by multiplying a tension control deviation that is a deviation between a set tension-control command value and the tension control amount, by a proportional gain, and integral compensation, obtained by integration with multiplying the tension control deviation by an integral gain; an adjustment-execution-command generation unit to output an adjustment execution command that becomes ON during a preset automatic adjustment period, based on an instruction input from outside; as binary output unit to output an additional value in adjustment, having an amplitude whose magnitude is a preset additional-value amplitude and having a positive or negative sign determined based on the tension control deviation, during the automatic adjustment period; a tension-shaft speed-command generation unit to receive the tension-shaft reference speed command, the tension-control correction value and the additional value in adjustment, and output the tension-shaft speed command based on addition or selection thereof; and a gain calculation unit to calculate the proportional gain and the integral gain based on a measurement result of an oscillation period and an amplitude of the tension control deviation, during the automatic adjustment period.

Advantageous Effects of Invention

According to the present invention, in conveyance between rollers, it is possible to set a gain of a tension-control calculation unit to an appropriate value in a short time, regardless of a situation of presetting of the control gain of the tension-control calculation unit, under various conditions such as conveyance speeds, without inconvenience of trial and error and without requiring knowledge based on experiences. In addition, there is exerted an advantageous effect in that it is possible to provide an apparatus for controlling conveyance between rollers, that enables a user to easily realize control of conveying a conveyed material between rollers while maintaining tension at a desired value.

DESCRIPTION OF EMBODIMENTS

Embodiments of an apparatus for controlling conveyance between rollers according to the present invention will be explained below in detail with reference to the accompanying drawings. The present invention is not limited to the embodiments.

First Embodiment

Figure 1:
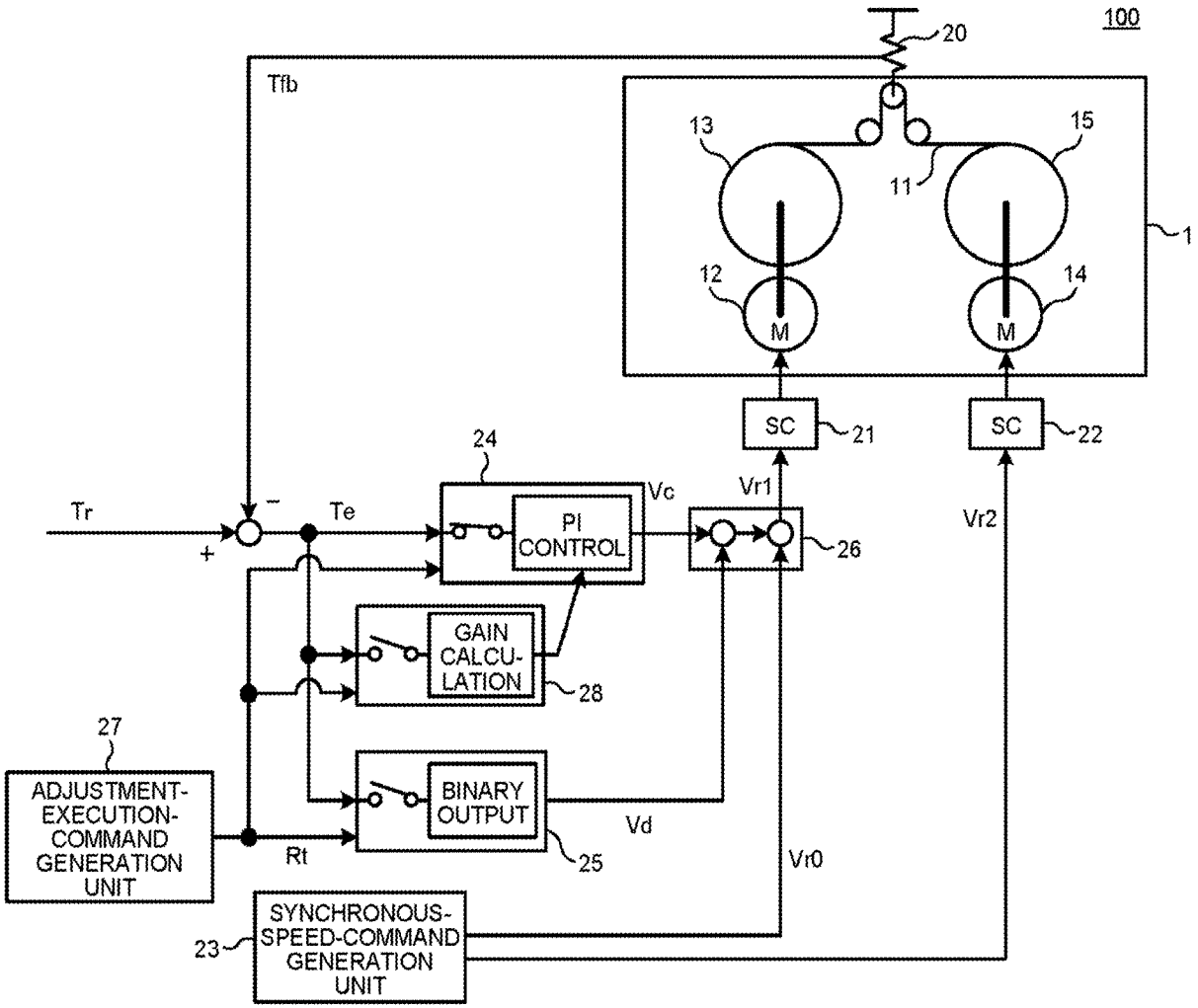
FIG. 1 is a block diagram illustrating a configuration of an apparatus for controlling conveyance between rollers according to a first embodiment of the present invention.

FIG. 1 is a block diagram illustrating a configuration of an apparatus 100 for controlling conveyance between rollers according to a first embodiment of the present invention.

A conveyance mechanism 1 between rollers is a mechanism of conveying a belt-like or linear conveyed material 11 made from a material such as paper, resin or metal, between a plurality of rollers, and winds the conveyed material 11 by driving and rotating a tension shaft roller 13 by a tension shaft motor 12. The conveyance mechanism between rollers 1 also unwinds the conveyed material 11 by driving and rotating a speed shaft roller 15 by a speed shaft motor 14. In this way, the conveyed material 11 is conveyed between the tension shaft roller 13 and the speed shaft roller 15.

The conveyance mechanism 1 between rollers is provided with a tension control-amount detector 20 and outputs a tension detection value Tfb that is a tension control amount obtained by detecting tension of the conveyed material 11. The tension detection value Tfb is a variable controlled so as to be a preset target value as described later.

In the present embodiment, it is described that the tension shaft roller 13 performs winding and the speed shaft roller 15 performs unwinding. However, winding and unwinding may be replaced with each other between the rollers, and further, it is conceivable that the tension shaft roller 13 and the speed shaft roller 15 does not perform winding and unwinding, and functions as an intermediate shaft that performs only feeding motion between winding and unwinding.

The apparatus 100 for controlling conveyance between rollers includes the tension control-amount detector 20, a tension-shaft speed controller 21, a speed-shaft speed controller 22, a synchronous-speed-command generation unit 23, a tension-control calculation unit 24, a binary output unit 25, a tension-shaft speed-command generation unit 26, an adjustment-execution-command, generation unit 27, and a gain calculation unit 28.

Operations of the apparatus 100 for controlling conveyance between rollers is described next.

The tension-shaft, speed controller 21 receives a tension-shaft speed command Vr1 as an input, and controls a rotation speed of the tension shaft motor 12 so that the speed at which the tension shaft roller 13 conveys the conveyed material 11 is equal to the tension-shaft speed command Vr1. Specifically, control is executed such that the rotation speed of the tension shaft motor 12 is equal to a command obtained by converting the tension-shaft speed command Vr1 to the rotation speed of the tension shaft motor 12, in consideration of a diameter and a speed reduction ratio of the tension shaft roller 13.

The speed-shaft speed controller 22 receives a speed-shaft speed command Vr2 as an input, and controls a rotation speed of the speed shaft motor 14 so that the speed at which the speed shaft roller 15 conveys the conveyed material 11 is equal to the speed-shaft speed command Vr2. Specifically, control is executed such that the rotation speed of the speed shaft motor 14 is equal to a command obtained by converting the speed-shaft speed command Vr2 to the rotation speed of the speed shaft motor 14, in consideration of a diameter and a speed reduction ratio of the speed shaft roller 15.

The synchronous-speed-command generation unit 23 outputs a tension-shaft reference speed command Vr0 that is a base for calculating the above-mentioned tension-shaft speed command Vr1, and the speed-shaft speed command Vr2. Under a normal condition, the tension-shaft reference speed command Vr0 and the speed-shaft speed command Vr2 have the same values, or values having a ratio or difference therebetween, that is determined in advance in consideration of an influence of expansion of the conveyed material 11. The tension-shaft reference speed command Vr0 and the speed-shaft speed command Vr2 are generated so as to vary with each other synchronously according to acceleration and deceleration of a conveyance speed of the conveyed material 11.

Next, the tension-control calculation unit 24 receives: a tension control deviation that is a deviation between a tension command Tr set as a tension control command and a tension detection value Tfb that is a tension control amount, namely, a tension deviation Te; and an adjustment execution command Rt described later, as inputs. In a normal state with the adjustment execution command Rt being OFF, the tension-control calculation unit 24 outputs a sum of proportional compensation obtained by multiplying the tension deviation Te by a proportional gain, and integral compensation obtained by integration with multiplying the tension deviation Te by an integral gain, as a tension-control correction value Vc. On the other hand, when the adjustment execution command Rt is ON to enter into an automatic adjustment period, the tension-control correction value Vc that, is an output thereof maintains a value immediately before the automatic adjustment period during which the adjustment execution command Rt is ON, and such a constant value is outputted. This operation to maintain the value immediately before the automatic adjustment period can be realized, for example, by setting the proportional gain and the integral gain to zero and holding an output of the integration. Accordingly, also in the automatic adjustment period, a stable control state immediately before the automatic adjustment period can be maintained, and regardless of changes of various conditions such as conveyance speeds, it is possible to realize stable shift to the automatic adjustment period during which automatic adjustment is performed as described later, and to set the gain of the tension-control calculation unit 24 to an appropriate value.

The adjustment-execution-command generation unit 27 then generates the adjustment, execution command Rt that is a signal indicating ON or OFF based on an instruction input such as an operation from outside. Basically, the adjustment execution command Rt is changed from OFF to ON according to an operation from outside, and after an ON signal is outputted only during the preset automatic adjustment period, the adjustment execution command Rt is returned to OFF. The preset period here is, for example, a preset certain period of time, or a period until a judgmental decision is made which an output of the binary output unit 25 described later has changed for the preset number of times.

Next, the binary output unit 25 operates in the automatic adjustment period during which the adjustment execution command Rt is ON, and outputs a value having an amplitude whose magnitude is a preset additional-value amplitude D based on the tension deviation Te, and having positive or negative sign determined according to a sign of the tension deviation Te, as an additional value in adjustment Vd. Specifically, the binary output unit 25 selects either +D or −D according to a sign of a deviation of the tension deviation Te. At the time of this selection, the selection may correspond to the sign of a result obtained by applying a low-pass filter to the tension deviation Te, or +D or −D may be selected not only by simply performing selection according to the sign of the tension deviation Te, but also based on a signal that provides nonlinear hysteresis characteristics to the tension deviation Te.

The operation of the binary output unit 25 described above is the same as a method referred to as "limit cycle method", which is used in temperature adjustment control or the like, in which when the adjustment execution command Rt is ON, the additional value in adjustment Vd outputted by the binary output unit 25 and the tension deviation Te oscillate at a constant frequency.

The gain calculation unit 28 then receives the tension deviation Te and the adjustment execution command Rt as inputs, and measures an oscillation period and an amplitude of the tension deviation Te in the automatic adjustment period during which the adjustment execution command Rt is ON. Based on a measurement result, the gain calculation unit 28 calculates and sets a proportional gain and an integral gain of the tension-control calculation unit 24. Specifically, the gain, calculation unit 28 sets the proportional gain as a value obtained by multiplying an inverse number of the amplitude of the tension deviation Te by a preset constant, and sets the integral gain in order that the integral time constant of proportional integral operation becomes a value obtained by multiplying the oscillation period by a present constant.

As a specific calculation method for the proportional gain and the integral gain, such a method can be used that a linearized gain of input and output of the binary output unit 25 is calculated based on, for example, a describing function method, and the proportional gain and the integral gain are determined based on an ultimate sensitivity method of Ziegler-Nichols. Accordingly, optimum adjustment can be performed according to the characteristics of the conveyed material 11 or the characteristics of the tension control-amount detector 20.

Next, the tension-shaft speed-command generation unit 26 outputs a value obtained by adding the tension-shaft reference speed command Vr0, the tension-control, correction value Vc, and the additional value in adjustment Vd described above, as the tension-shaft speed command Vr1.

Now, some features of the apparatus 100 for controlling conveyance between rollers according to the present embodiment are described.

Firstly, description is given for features of a part other than the adjustment-execution-command generation unit 27, the binary output unit 25, and the gain calculation unit 28. In order to execute conveyance control of the conveyed material 11 stably from the speed shaft roller 15 that performs unwinding to the tension shaft roller 13 that performs winding, the synchronous-speed-command generation unit 23 outputs the tension-shaft reference speed command Vr0 and the speed-shaft speed command Vr2 having the same values or an appropriate difference therebetween as described above. The tension-shaft speed controller 21 controls the rotation speed of the tension shaft motor 12 in consideration of the diameter of the tension shaft roller 13 so that the conveyance speed of the tension shaft roller 13 is equal to the tension-shaft speed command Vr1 having a base of the tension-shaft reference speed command Vr0. The speed-shaft speed controller 22 controls the rotation speed of the speed shaft motor 14 in consideration of the diameter of the speed shaft roller 15 so that the conveyance speed of the speed shaft, roller 15 is equal to the speed-shaft, speed command Vr1.

It is difficult to set the diameters of the tension shaft roller 13 and the speed shaft roller 15 completely accurately. Therefore, if the tension-control calculation unit 24 does not perform an appropriate operation, the conveyed material 11 cannot be conveyed while maintaining the tension of the conveyed material 11 at a preset value that is a target value. Accordingly, creases or slack may be generated in the conveyed material 11, or conversely, such a phenomenon that the conveyed material 11 is fractured due to excessive tension occurs, thereby being unable to convey the conveyed material 11 stably. In other words, in order to stably perform conveyance of the conveyed material 11 between rollers, if there are not both the operation of the synchronous-speed-command generation unit 23 to appropriately generate the speed-shaft speed command Vr2 and the tension-shaft reference speed command Vr0, and the operation of the tension-control calculation unit 24 having appropriate settings of the proportional gain and the integral gain to add the tension-control correction value Vc and generate the speed-shaft speed command Vr2, it is difficult to stably perform conveyance of the conveyed material 11 between rollers.

If the adjustment-execution-command generation unit 27, the binary output unit 25 and the gain calculation unit 28 are not provided, the configuration becomes similar to the configuration of a conventional apparatus for controlling conveyance between rollers. In this case, to set the gain of the tension-control calculation unit 24, that is, the proportional gain and the integral gain thereof, the synchronous-speed-command generation unit 23 performs acceleration or deceleration, and the like, and the gain is adjusted, while observing changes of the tension detection value Tfb at that instant.

However, as described above, if the gain of the tension-control calculation unit 24 is not set appropriately, it is difficult to stably convey the conveyed material 11 between rollers.

To this end, conventionally, acceleration and deceleration or the speed by the synchronous-speed-command generation unit 23 is set to a small value, and adjustment of the gain of the tension-control calculation unit 24 is started from a moderately conveying state. An operation to realize desired conveyance motion between rollers by an operator is then required such that after the change of the tension detection value Tfb becomes stable to some extent, gradual change of setting by the synchronous-speed-command generation unit 23 and gradual adjustment of the gain of the tension-control calculation unit 24 are repeated so that the behavior of the tension detection value Tfb becomes stable even if a magnitude of acceleration and deceleration or the speed of the synchronous-speed-command generation unit 23 is large. However, according to the apparatus 100 for controlling conveyance between rollers of the present embodiment, such an operation is not required.

Next, description is given for the operation of the apparatus 100 for controlling conveyance between rollers having the adjustment-execution-command generation unit 27, the binary output unit 25, and the gain calculation unit 26 added.

Figure 2:
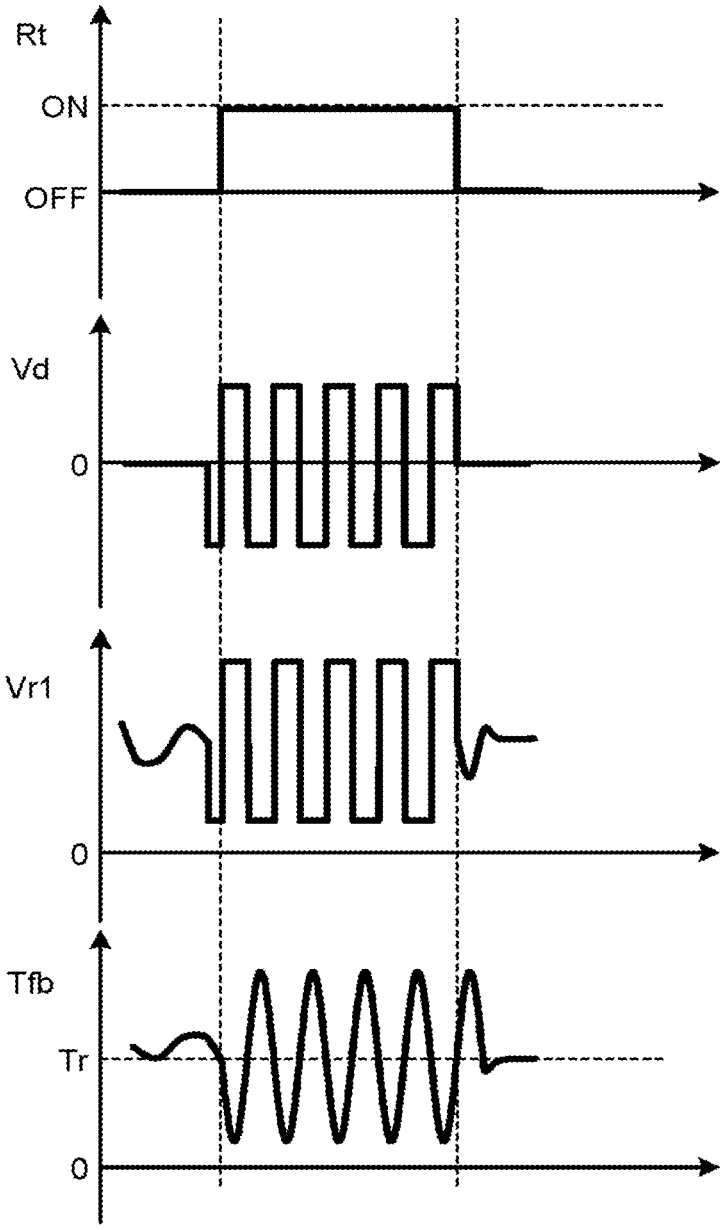
FIG. 2 is a time response graph illustrating the behavior of the apparatus for controlling conveyance between rollers according to the first embodiment of the present invent ion.

While the adjustment execution command Rt output by the adjustment-execution-command generation unit 27 is ON, self-excited oscillation referred to as "limit cycle" occurs as described above. An example of time response of the additional value in adjustment Vd and the tension detection value Tfb at this time is illustrated in FIG. 2. FIG. 2 is a time response graph illustrating the behavior of the apparatus 100 for controlling conveyance between rollers according to the first embodiment of the present invent ion.

FIG. 2 illustrates the adjustment execution command Rt, the additional value in adjustment Vd, the tension-shaft speed command Vr1, and the tension detection value Tfb from a top thereof.

In this example, it is assumed that before the adjustment execution command Rt becomes ON, the gain of the tension-control calculation unit 24 is set roughly as a sufficiently small value, and in this case, the stability of the tension deviation Te is in a bad state.

Next, when the adjustment execution command Rt becomes ON, the additional value in adjustment Vd takes a value of +D or −D according to the positive or negative sign of the tension deviation Te, and the tension deviation Te changes accordingly. Therefore, the additional value in adjustment Vd and the tension deviation Te oscillate at a substantially constant frequency. That is, self-excited oscillation due to the limit cycle occurs.

As described above, the gain calculation unit 28 calculates the proportional gain and the integral gain of the tension-control calculation unit 24 based on the oscillation period and the amplitude of the tension deviation Te in the period during which the adjustment execution command Rt is ON. And as described above, the adjustment-execution-command generation unit 27 sets the adjustment execution command Rt to OFF, and the gain calculation unit 26 sets the calculated proportional gain and integral gain to the tension-control calculation unit 24. That is, the adjustment is complete.

For the adjustment period that is a preset period during which the adjustment execution command Rt is ON, a time length may be set beforehand as described above. However, in the case where various materials such as hard metal or soft resin are to be conveyed, an oscillational frequency due to the limit cycle is largely different, and a response frequency in control that can be realized is also largely different. For this reason, it is desired to make configuration such that the adjustment period is finished by counting the oscillational frequency of the tension deviation Te to the preset number.

In this case, in a case of a material that does not expand so much such as metal or paper, oscillation due to the limit cycle occurs at a speed of several hertz or higher. Therefore, about one second is sufficient as the adjustment period. For a material having greater expansion due to a tension change such as resin, response of control that can be realized is slow.

Even in such a case, about several seconds is sufficient as the adjustment period, and an optimum gain can be set in a short time and with only one adjustment operation.

In the embodiment described above, before the adjustment is performed with setting the adjustment execution command Rt to ON, the gain of the tension-control calculation unit 24 is low and stability is poor. However, when it is configured to slowly accelerate the adjustment-execution-command generation unit 27 to a desired speed and maintain as constant speed at the desired speed, adjustment can be performed at a desired conveyance speed.

In the embodiment described above, the case has been given where the gain of the tension-control calculation unit 24 is low and stability is poor before the adjustment is performed with setting the adjustment execution command Rt to ON. On the contrary, it goes without saying that after the gain of the tension-control calculation unit 24 is adjusted once, readjustment can be performed at the desired conveyance speed even in the case where the gain of the tension-control calculation unit 24 becomes too high due to a factor such as an environmental change.

In the above, it has been described that the tension control-amount detector 20 outputs the tension detection value Tfb. However, the tension control-amount detector 20 does not necessarily output the tension itself of the conveyed material 11. For example, the tension control-amount detector 20 may be configured to press a mechanism referred to as "dancer" against the conveyed material 11 with a preset force and detect a dancer displacement that is a displacement amount thereof.

As described above, a variable, whose output changes due to an influence of tension fluctuation, may be detected without the tension of the conveyed material 11 being directly outputted by the tension control-amount detector 20. In other words, the tension control-amount detector 20 only needs to detect a tension control amount that is a variable that can maintain the tension of the conveyed material 11 at a constant value by executing control so that the value has a preset constant value. The above descriptions can be directly applied to this case by replacing the tension detection value Tfb, the tension command Tr and the tension deviation Te in the above descriptions by a tension control amount, a tension control command and a tension control deviation, respectively, as appropriate.

In the above descriptions, the binary output unit 25 is configured to output a value selected from two values of +D and −D according to the sign of the tension deviation Te as the additional value in adjustment Vd. As an alternative for it, a limiter whose magnitude is the additional-value amplitude D can be applied to a value obtained by multiplying the tension deviation Te by a sufficiently large proportional gain, to output the additional value in adjustment Vd. By doing so, substantially the same motion as the motion described above can be acquired, and it is possible that a signal having an amplitude whose magnitude is the additional-value amplitude D, and having a positive or negative sign determined based on the tension deviation Te, is calculated as the additional value in adjustment Vd, and the change of the additional value in adjustment Vd is made continuous.

In the above, it is described that a result of calculation of the proportional gain and the integral gain obtained by the gain calculation unit 28 is sec in the tension-control calculation unit 24. However, the calculation result may be displayed so as to prompt an operator to set it.

Furthermore, it has been described that the tension-control calculation unit 24 has proportional compensation and integral compensation. However, needless to mention, derivative compensation may be added thereto.

According to the present embodiment, by virtue of operation in a manner as described above, a gain of the tension-control calculation unit 24 can be set to an appropriate value in a short time, regardless of situation of presetting the control gain of the tension-control calculation unit 24 under various conditions such as conveyance speeds. That is, it is possible to provide an apparatus for controlling conveyance between rollers, that can set a gain of the tension-control calculation unit 24 to an appropriate value in a short time, and enables a user to easily realize control of conveying the conveyed material between rollers while maintaining tension at a preset value that is a target value, regardless of a situation of presetting of the control gain of the tension-control calculation unit 24, under a condition of any conveyance speed, without inconvenience of trial and error and without requiring knowledge based on experiences.

Second Embodiment

In the descriptions of the apparatus 100 for controlling conveyance between rollers according to the first embodiment, the gain of the tension-control calculation unit 24 is adjusted in a short time in an operating state of an arbitrary conveyance speed. In the present embodiment, adjustment of the gain of the tension-control calculation unit is automatically performed before starting a conveyance operation between rollers at the time of initial startup.

Figure 3:
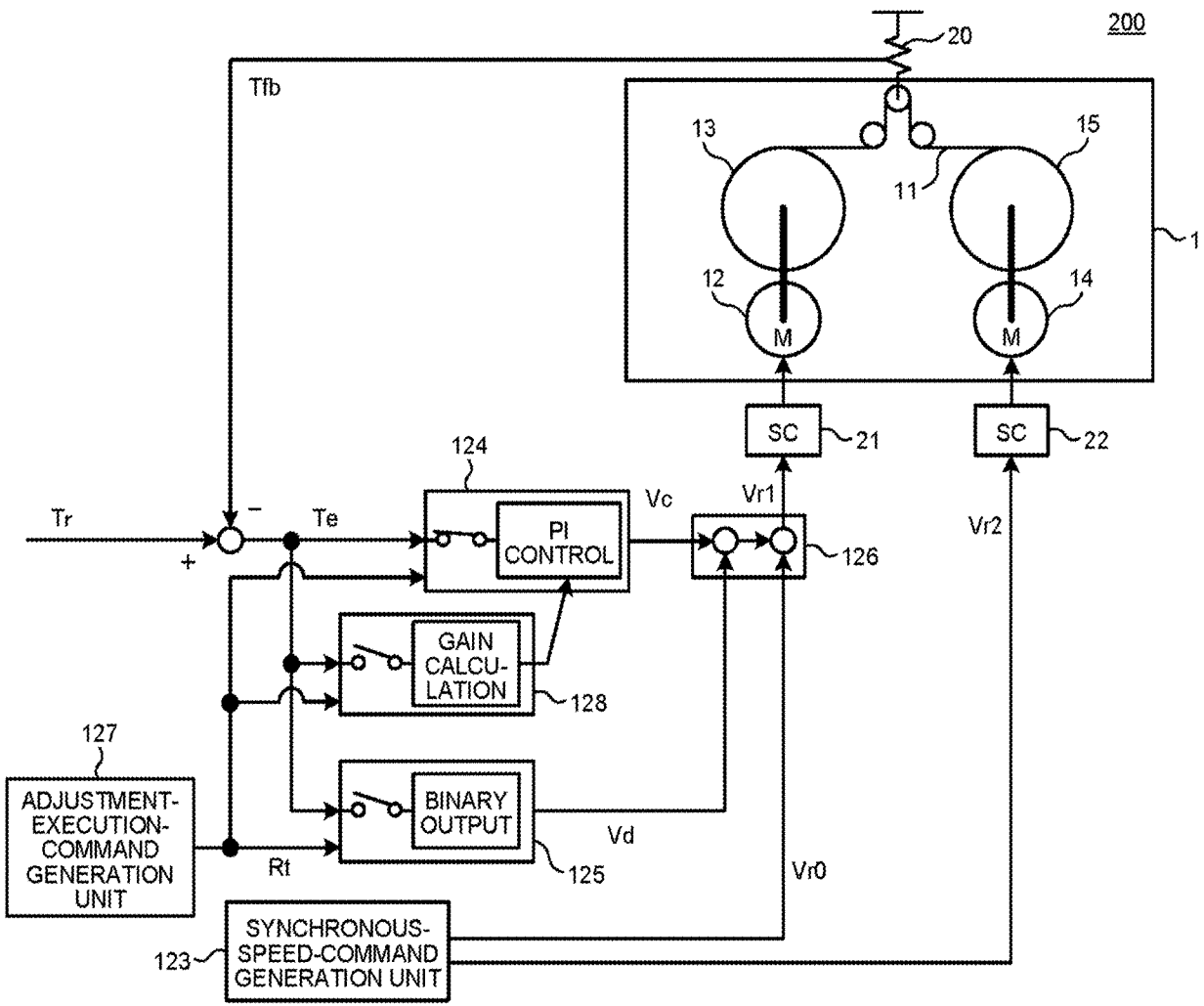
FIG. 3 is a block diagram illustrating a configuration of an apparatus for controlling conveyance between rollers according to a second embodiment of the present invention.

FIG. 3 is a block diagram illustrating a configuration of an apparatus 200 for controlling conveyance between rollers according to a second embodiment of the present invention. The same reference signs as those of FIGS. 1 and 5 refer to the same parts as those in the first and third embodiments, and explanations thereof will be omitted.

The apparatus 200 for controlling conveyance between rollers according to the present embodiment is applied at the time of startup before starting a conveyance operation between rollers for the conveyed material 11.

A synchronous-speed-command generation unit 123 is basically the same as the synchronous-speed-command generation unit 23 according to the first embodiment. However, before starting the conveyance operation between rollers at the time of initial startup, the synchronous-speed-command generation unit 123 sets the tension-shaft reference speed command Vr0 to zero and sets the speed-shaft speed command Vr2 to zero, and outputs these commands.

A tension-control calculation unit 124 receives the tension deviation Te that is a deviation between the set tension command Tr and the tension detection value Tfb, and the adjustment execution command Rt, as inputs. In a normal state where the adjustment execution command Rt has once become ON and then is changed to OFF, as described later, the tension-control calculation unit 124 performs a similar operation to that of the tension-control calculation unit 24 according to the first embodiment. That is, the tension-control calculation unit 124 outputs a sum of the proportional compensation obtained by multiplying the tension deviation Te by the proportional gain and the integral compensation obtained by integration with multiplying the tension deviation Te by the integral gain, as the tension-control correction value Vc.

The tension-control calculation unit 124 outputs the tension-control correction value Vc as zero, in an OFF period before starting the conveyance operation between rollers at the time of initial startup, and until the adjustment execution command Rt is changed to ON. In this operation, the tension-control correction value Vc is set to zero based on a step of setting the proportional gain and the integral gain to zero, or a step of setting so as not to perform the control calculation. Accordingly, even if the conveyance motion between rollers is not performed beforehand, the gain of the tension-control calculation unit 124 can be set to an appropriate value, by shifting to an automatic adjustment period during which the adjustment execution command Rt becomes ON, regardless of a situation of presetting the control gain of the tension-control calculation unit 124.

The tension-control calculation unit 124 also outputs the tension-control correction value Vc that, holds the zero value even in a period during which the adjustment execution command Rt is ON.

An adjustment-execution-command generation unit 127 generates the adjustment execution command Rt, that is a signal indicating ON or OFF based on an operation from outside. The apparatus 200 for controlling conveyance between rollers according to the present embodiment performs adjustment of the tension-control calculation unit 124 before starting the conveyance operation between rollers at the time of initial startup, and therefore changes the adjustment execution command Rt to ON, after having confirmed that the tension-shaft reference speed command Vr0 and the speed-shaft speed command Vr2 outputted by the synchronous-speed-command generation unit 123 are both zero.

Regarding the tension-shaft reference speed command Vr0 and the speed-shaft speed command Vr2, if either one is zero, both need to be zero to obtain physical consistency. Therefore, it is sufficient to confirm that either one is zero. A confirmation method thereof can be realized by actually monitoring the tension-shaft, reference speed command Vr0 or the speed-shaft, speed command Vr2. However, in practice, the confirmation method can be realized by reading a variable or the like representing an operating mode based on an operator's operation in the apparatus 200 for controlling conveyance between rollers. Accordingly, the gain of the tension-control calculation unit 124 can be set to an appropriate value, by shifting to an automatic adjustment period during which the adjustment execution command Rt becomes ON, regardless of a situation of presetting the control gain of the tension-control calculation unit 124, without, performing the conveyance motion between rollers beforehand.

Next, a binary output unit 125 operates in a period during which the adjustment execution command Rt is ON, and outputs a signal having an amplitude whose magnitude is the additional-value amplitude D set so as to change with passage of time based on the tension deviation Te, and having positive or negative sign determined, based on the tension deviation Te, that is, a value obtained by selecting one of two values of +D and −D according to the sign of the tension deviation Te, as the additional value in adjustment Vd.

Specifically, the binary output unit 125 sets the additional-value amplitude D that is the amplitude of the additional value in adjustment Vd, to a relatively small value in a period from a time point when the adjustment execution command Rt becomes ON until the sign of the tension deviation Te first changes. That is, the additional-value amplitude D in the period from the time point when the adjustment execution command Rt becomes ON until the sign of the tension deviation Te first changes is set to be smaller than the additional-value amplitude D at or after the time point when the sign of the tension deviation Te first changes. By so doing, the behavior at the time of starting adjustment can be stabilized further.

After the sign of the tension deviation Te has first changed, the additional value in adjustment Vd having the additional-value amplitude D having a preset value is outputted as with the first embodiment. As a result, after the sign of the tension deviation Te has first changed, the additional value in adjustment Vd and the tension deviation Te oscillate at a generally constant frequency.

Subsequently, a gain calculation unit 128 measures an oscillation period and an amplitude of oscillation of the tension deviation Te after the sign of the tension deviation Te has first changed, and calculates and sets the proportional gain and the integral gain for the tension-control calculation unit 124 based on the measurement result, as with the first embodiment.

Figure 4:
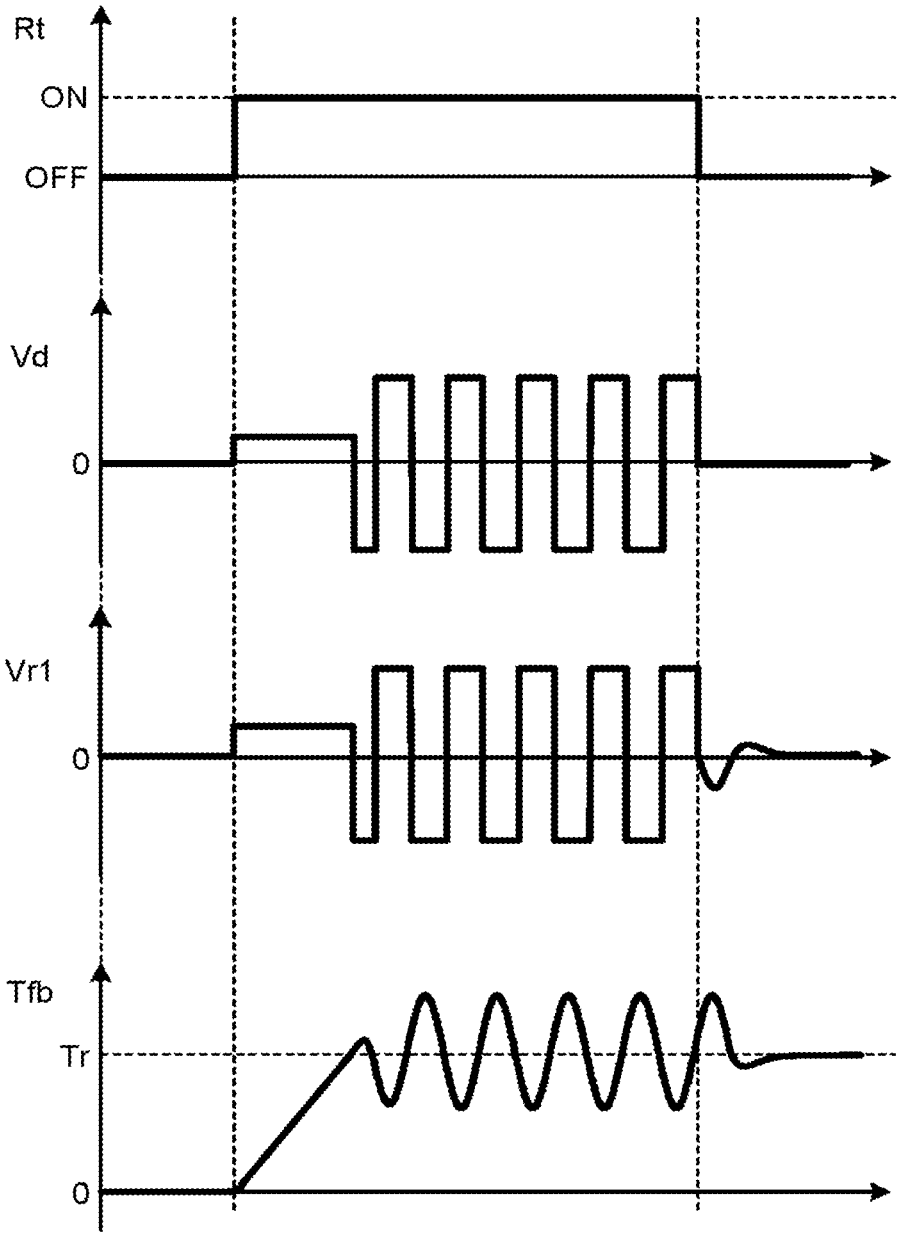
FIG. 4 is a time response graph illustrating the behavior of the apparatus for controlling conveyance between rollers according to the second embodiment of the present invention.

FIG. 4 is a time response graph illustrating the behavior of the apparatus 200 for controlling conveyance between rollers according to the second embodiment of the present invention. FIG. 4 shows the adjustment execution command Rt, the additional value in adjustment Vd, the tension-shaft speed command Vr1 and the tension detection value Tfb in the case of using the apparatus 200 for controlling conveyance between rollers.

As illustrated in FIG. 4, before the adjustment execution command Rt becomes ON, the apparatus is in an initial startup state, and so the tension-shaft reference speed command Vr0 is zero. Therefore, the additional value in adjustment Vd and the tension-shaft speed command Vr1 have the same values. The tension, detection value Tfb is also zero.

Immediately after the adjustment execution command Rt has become ON, the amplitude of the additional value in adjustment Vd is set as a relatively small value. Therefore, the tension detection value Tfb moderately increases. Further, the sign of the tension deviation Te changes at the moment when the tension detection value Tfb exceeds the set tension command Tr, and thereafter, the additional value in adjustment Vd oscillates positively and negatively with an amplitude set to a relatively large value. As a result, the tension detection value Tfb oscillates with relatively steep inclination and a relatively large amplitude.

As described above, an absolute value of the additional value in adjustment Vd immediately after the adjustment execution command Rt has changed to ON is set to be smaller than an absolute value of the additional value in adjustment Vd at or after the time point when the sign of the tension deviation Te first changes. By virtue of this setting, with gradually generating tension from a state where the conveyed material 11 between rollers may be zero in tension and so loose, motion that is difficult to be predicted until the tension is first generated can be performed stably as much as possible. Further, once tension is generated, the apparatus can be operated with a relatively large amplitude so that measurement of the amplitude and the frequency of the tension deviation Te can be performed more accurately.

Because the apparatus 200 for controlling conveyance between rollers according to the present embodiment operates as described above, even in a case where the gain of the tension-control calculation unit 124 has not been set at ail before starting the conveyance operation between rollers at the time of initial startup, the gain of the tension-control calculation unit 124 can be set to an appropriate value in a short time with stable motion, without inconvenience of trial and error and without requiring knowledge based on experiences. Accordingly, it is possible to provide the apparatus for controlling conveyance between rollers, with which a user can easily realize control of conveying the conveyed material 11 between rollers while maintaining the tension at a preset value that is a target value.

Third Embodiment

In the second embodiment, it is assumed that the additional-value amplitude D that is an amplitude of the additional value in adjustment Vd that is an output value of the binary output unit 125, that is, the amplitude of the tension shaft speed has been set beforehand. However, such a configuration is also possible that an oscillation amplitude of the tension deviation Te equal to a preset value at the time of performing the adjustment.

Figure 5:
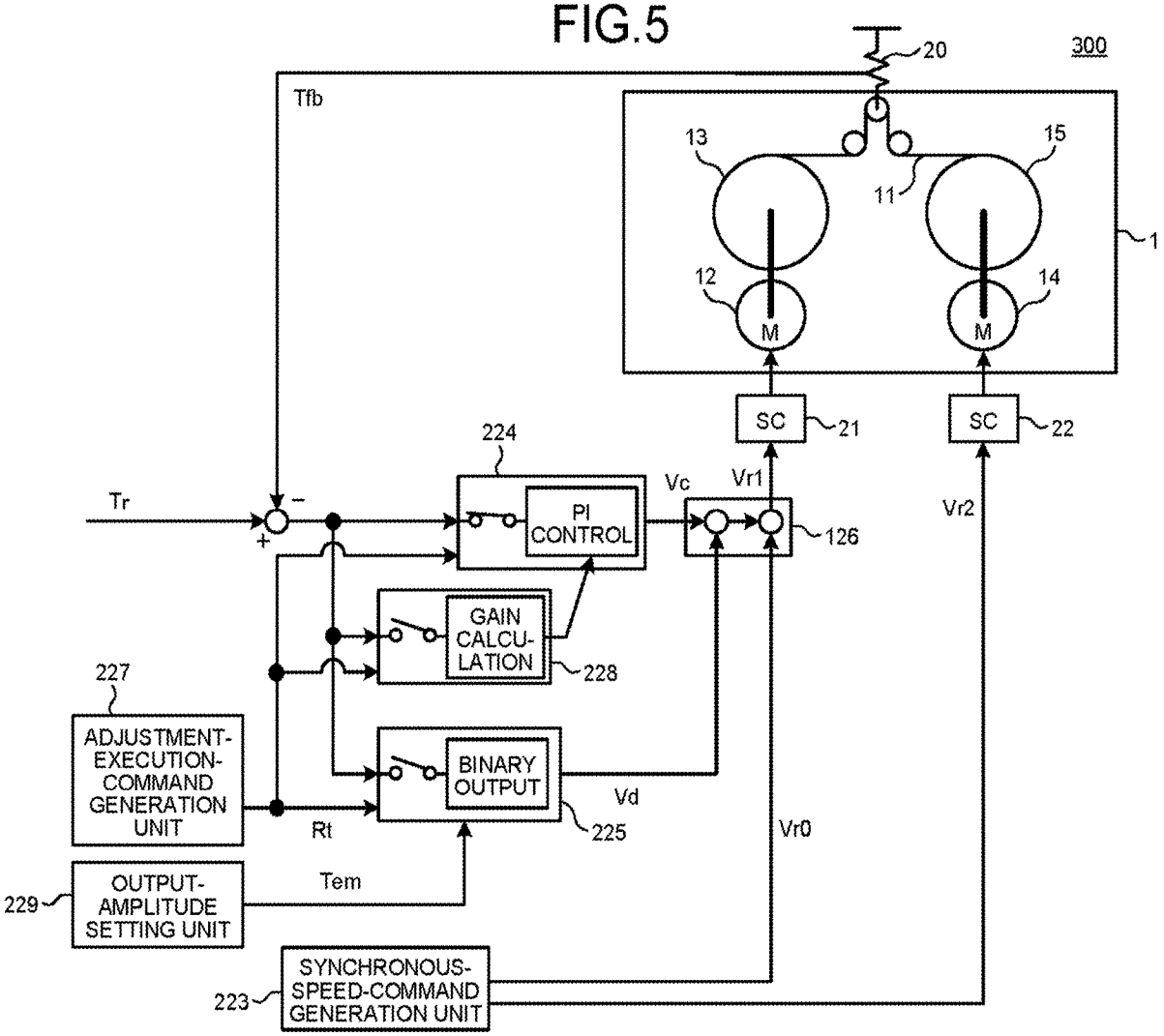
FIG. 5 is a block diagram illustrating a configuration of an apparatus for controlling conveyance between rollers according to a third embodiment of the present invention.

FIG. 5 is a block diagram representing a configuration of an apparatus 300 for controlling conveyance between rollers according to a third embodiment of the present invention. The same reference signs as those of FIG. 1 refer to the same parts as those in the first embodiment, and explanations thereof will be omitted.

The apparatus 300 for controlling conveyance between rollers according to the present embodiment is applied at the time of startup before starting a conveyance operation between rollers for the conveyed material 11.

In the following descriptions, it is explained that the tension control-amount detector 20 detects the tension detection value Tfb. However, the present embodiment can be applied similarly to the case where a tension control amount such as dancer displacement is outputted, as described in the first embodiment.

A synchronous-speed-command generation unit 223 is basically the same as the synchronous-speed-command generation unit 23 of the first embodiment. However, before starting a conveyance operation between rollers at the time of initial startup, the synchronous-speed-command generation unit 223 sets the tension-shaft reference speed command Vr0 to zero and sets the speed-shaft speed command Vr2 to zero, and outputs these commands.

A tension-control calculation unit 224 receives the tension deviation Te that is a deviation between the set tension command Tr and the tension detection value Tfb, and the adjustment execution command Rt as inputs. In a normal state where the adjustment execution command Rt has once become ON and then is changed to OFF, as described later, the tension-control calculation unit 224 performs a similar operation to that of the tension-control calculation unit 24 of the first embodiment. That is, the tension-control calculation unit 224 outputs a sum of the proportional compensation obtained by multiplying the tension deviation Te by the proportional gain and the integral compensation obtained by integration with multiplying the tension deviation by the integral gain, as the tension-control correction value Vc. Further, the tension-control calculation unit 224 outputs the tension-control correction value Vc as zero, in an OFF period before starting the conveyance operation between rollers at the time of initial startup, and until the adjustment execution command Rt is changed to ON. In this operation, the tension-control correction value Vc is set to zero by setting the proportional gain and the integral gain to zero, or setting so as not to perform the control calculation. The tension-control calculation unit 224 also outputs the tension-control correction value Vc that holds the zero value even in a period during which the adjustment execution command Rt becomes ON.

An adjustment-execution-command generation unit 227 then generates the adjustment execution command Rt that is a signal indicating ON or OFF based on an operation from outside. The apparatus 300 for controlling conveyance between rollers according to the present embodiment performs adjustment of the tension-control calculation unit 224 before starting the conveyance operation between rollers at the time of initial startup. Accordingly, the apparatus 300 changes the adjustment execution command Rt to ON after having confirmed that the tension-shaft reference speed command Vr0 and the speed-shaft speed command Vr2 outputted by the synchronous-speed-command generation unit 223 are both zero. The operation of the adjustment-execution-command generation unit 227 to set the adjustment execution command Rt to OFF is described later.

An output-amplitude setting unit 229 is caused to nave input of a tension-amplitude set value Tem through setting by an operator or the like and outputs the tension-amplitude set value Tem to a binary output unit 225.

The binary output unit 225 receives the tension deviation Te, the adjustment execution command Rt and the tension-amplitude set value Tem, as inputs. The binary output unit 225 determines the additional value in adjustment Vd based on the tension deviation Te and the tension-amplitude set value Tem as described below in detail, and outputs the additional value in adjustment Vd.

A binary output unit 225 performs a similar operation to that of the binary output unit 125 of the second embodiment, and outputs a signal having an amplitude whose magnitude is the additional-value amplitude D set so as to change with passage of time when the adjustment execution command Rt is ON, based on the tension deviation Te, and having a positive or negative sign determined based on the tension deviation Te, that is, a value obtained by selecting one of two values of +D and −D according to the sign of the tension deviation Te, as the additional value in adjustment Vd. The additional-value amplitude D is determined by an amplitude determination unit 225*c* as described below.

Figure 6:
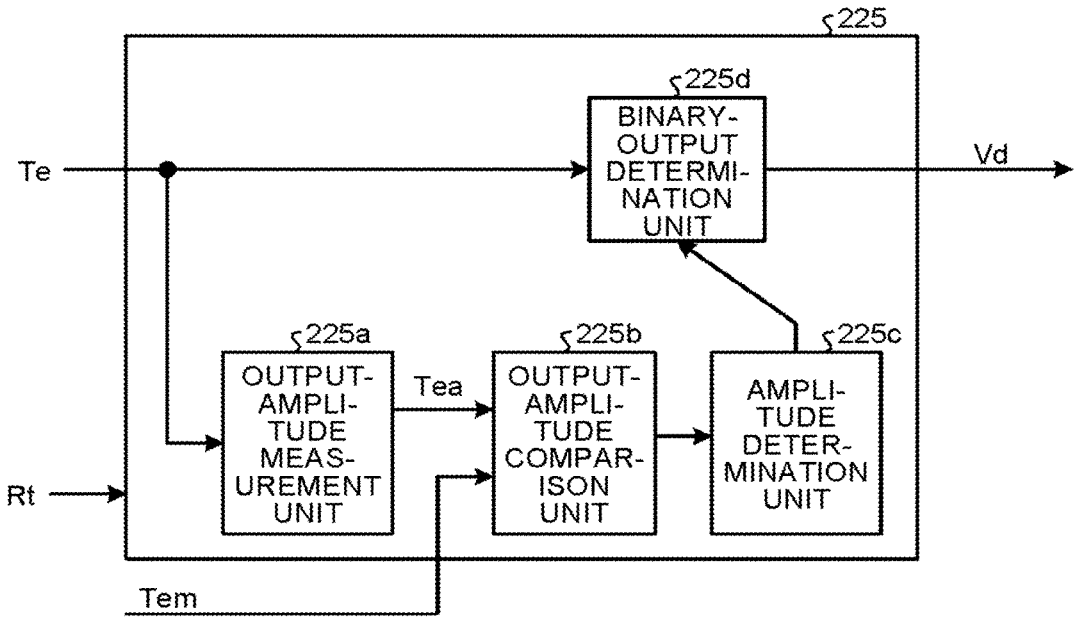
FIG. 6 is a block diagram illustrating a configuration of a binary output unit according to the third embodiment of the present invention.

FIG. 6 is a block diagram illustrating a configuration of the binary output unit 225 according to the third embodiment of the present invention.

Detailed operation of the binary output unit 225 is described next with reference to FIG. 6. The binary output unit 225 receives the tension deviation Te, the adjustment execution command Rt and the tension-amplitude set value Tem, as inputs, and operates only when the adjustment execution command Rt is ON. Further, the binary output unit 225 includes an output-amplitude measurement unit 225*a*, an output-amplitude comparison unit 225*b*, the amplitude determination unit 225*c* and the binary-output determination unit 225*d* as its constituent elements.

The output-amplitude measurement unit 225*a* measures oscillation of the tension deviation Te that is a tension control deviation for one cycle and outputs the amplitude thereof as a tension deviation amplitude Tea for each oscillation period.

The output-amplitude comparison unit 225*b* judges whether the tension deviation amplitude Tea described above is smaller than the tension-amplitude set value Tem, and outputs a result thereof to the amplitude determination unit 225*c*.

The amplitude determination unit 225*c* is a part for determining the additional-value amplitude D that is an amplitude of the additional value in adjustment Vd outputted by the binary-output determination unit 225*d*. Before the adjustment execution command Rt becomes ON, a minute value such as 1/100 or less is set therein, which is very small as compared with a desired conveyance speed or a conveyance speed obtained by conversion from a rated speed of the tension shaft motor 12.

After the adjustment execution command Rt has become ON, the amplitude determination unit 225*c* changes the additional-value amplitude D so as to increase gradually from an initial value while the tension deviation amplitude Tea is smaller than the tension-amplitude set value Tem, based on an output from the output-amplitude comparison unit 225*b*. When it is judged that the tension deviation amplitude Tea has reached the tension-amplitude set value Tem, the amplitude determination unit 225*c* stops changing the additional-value amplitude D and maintains the additional-value amplitude D at a constant value.

Next, a gain calculation unit 228 receives the tension deviation Te and the adjustment execution command Rt as inputs. The gain calculation unit 228 measures an oscillation period and an amplitude of the tension deviation Te in a period during which the adjustment execution command Rt is ON, more preferably, in a period during which the amplitude determination unit 225*c* stops changing the additional-value amplitude D. The gain calculation unit 228 then calculates the proportional gain and the integral gain of the tension-control calculation unit 224 as with the first embodiment, and sets the gains when the adjustment execution command Rt becomes OFF.

An operation of the adjustment-execution-command generation unit 227 to set the adjustment execution command Rt to OFF is not illustrated here. However, after the amplitude determination unit 225*c* stops changing the additional-value amplitude D, the adjustment-execution-command generation unit 227 sets the adjustment execution command Rt to OFF on the basis of counting a preset time, or judging that oscillation of the additional value in adjustment Vd or the tension deviation Te has occurred more than the preset number of times.

Figure 7:
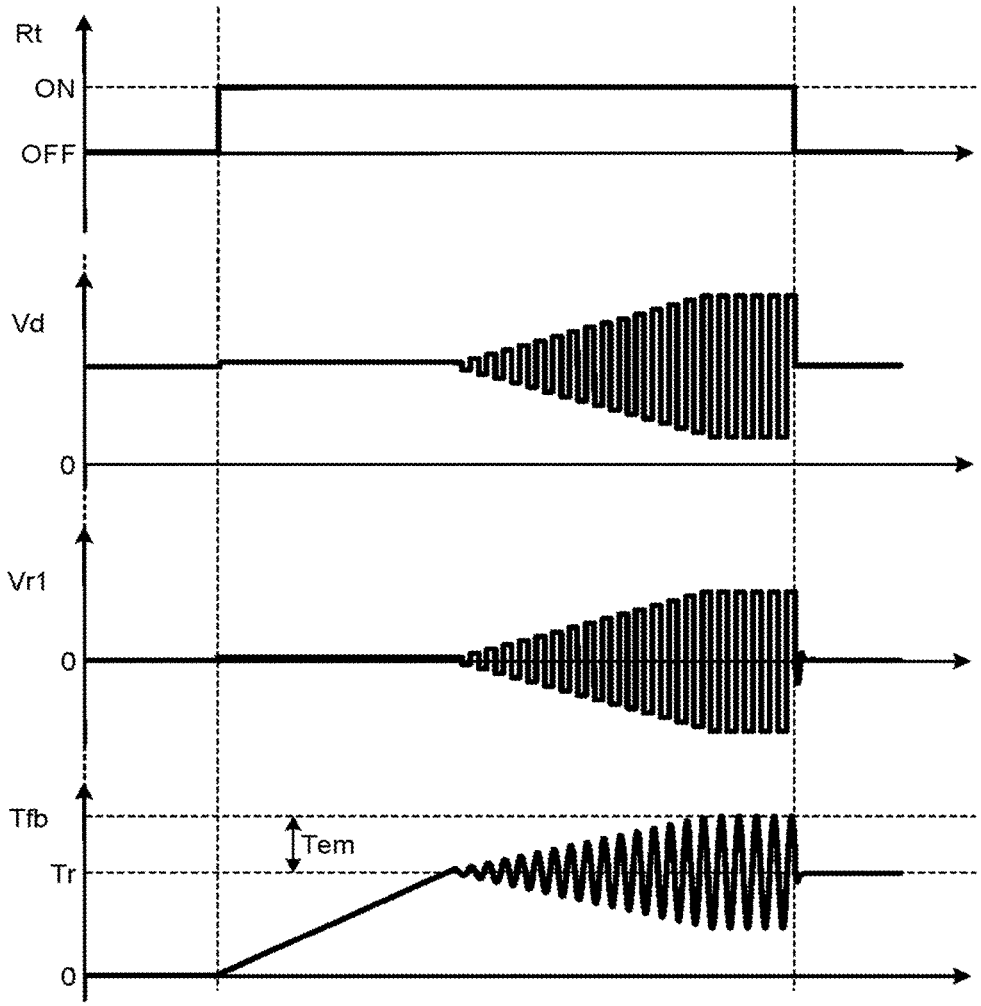
FIG. 7 is a time response graph illustrating the behavior of the apparatus for controlling conveyance between rollers according to the third embodiment of the present invention.

The behavior of the apparatus 300 for controlling conveyance between rollers having the above-mentioned operation is described with reference to FIG. 7. FIG. 7 is a time response graph illustrating the behavior of the apparatus 300 for controlling conveyance between rollers according to the third embodiment of the present invention.

The present embodiment, is directed to a case where before the adjustment execution command Rt becomes ON, the tension-shaft reference speed command Vr0 and the tension-shaft speed command Vr1 are both set to zero. Further, the tension-control correction value Vc outputted by the tension-control calculation unit 224 is also zero as described above. As a result, the tension-shaft speed command Vr1 is zero. Because the present embodiment is carried out at the time of startup before starting a conveyance operation between rollers, the tension detection value Tfb is also zero.

Next, when the adjustment execution command Rt becomes ON, the additional value in adjustment Vd whose magnitude is a minute value set by the amplitude determination unit 225*c* as the initial value of the additional-value amplitude D of the additional value in adjustment Vd outputted by the binary-output determination unit 225*d*, and the tension-shaft speed command Vr1 having the same value are generated. Accordingly, the tension detection value Tfb gradually increases.

After the tension detection value Tfb reaches the tension command Tr, the additional value in adjustment Vd, the tension-shaft speed command Vr1, and the tension detection value Tfb oscillate at a generally constant, frequency. As the amplitude determination unit 225*c* gradually increases the additional-value amplitude D, the amplitudes of the additional value in adjustment Vd, the tension-shaft, speed command Vr1, and the tension detection value Tfb gradually increase.

Subsequently, when the tension deviation Te that is a difference between the tension command Tr and the tension detection value Tfb reaches the tension-amplitude set value Tem set by the output-amplitude setting unit 229, the additional-value amplitude D determined by the amplitude determination unit 225*c* is maintained at a constant value, and thereby the additional value in adjustment Vd, the tension-shaft speed command Vr1, and the tension detection value Tfb oscillate with a constant amplitude.

After a period during which the additional value in adjustment Vd oscillates with the constant additional-value amplitude D continues to some extent, the adjustment execution command Rt becomes OFF, and the gain calculation unit 228 calculates and sets the proportional gain and the integral gain of the tension-control calculation unit 224 as described above.

Next, a tension-shaft speed-command generation unit 126 outputs a value obtained by adding the tension-shaft reference speed command Vr0, the tension-control correction value Vc, and the additional value in adjustment Vd described above as the tension-shaft speed command Vr1. However, in a period in which the adjustment execution command Rt has once become ON and then is changed to OFF, that is, in a period until the adjustment is complete, the tension-shaft reference speed command Vr0 and the tension-control correction value Vc are both zero, and after completion of the adjustment, the additional value in adjustment Vd is zero. Therefore, configuration can also be realized by selection and addition so that the additional value in adjustment Vd is set to be the tension-shaft speed command Vr1 before completion of the adjustment, and a sum of the tension-shaft reference speed command Vr0 and the tension-control correction value Vc is set to be the tension-shaft speed command Vr1 after completion of the adjustment.

Effects of the apparatus 300 for controlling conveyance between rollers according to the present embodiment having operation in a manner as described above are described.

An advantage of the apparatus 300 for controlling conveyance between rollers according to the present embodiment is that an amplitude of the additional value in adjustment Vd can be automatically determined so that an amplitude of the tension deviation Te during self-excited oscillation approaches a preset value.

The first and second embodiments are directed to beforehand determining a value of a magnitude of the additional-value amplitude D of the additional value in adjustment Vd outputted by the binary output unit. As a result, since the oscillation amplitude of the tension detection value Tfb cannot be grasped beforehand, the oscillation amplitude may become larger than anticipated. In such a case, for example, if the oscillation amplitude of the tension detection value Tfb becomes larger than the tension command Tr, the tension of the conveyed material 11 tends to become negative, that is, the conveyed material 11 may be loosened between rollers, thereby possibly causing a mechanistic problem. Further, when the tension control-amount detector 20 outputs dancer displacement instead of the tension detection value Tfb as the tension control amount, as described above, a fluctuation range of the dancer displacement may be mechanically limited. In this case, a problem may be caused if the amplitude of the tension control amount becomes too much larger than a preset value.

On the other hand, in the first or second embodiment, if the set additional-value amplitude D is too small, and the amplitude of the tension deviation Te is too small during self-excited oscillation, then the amplitude is buried in noise, and so the behavior thereof cannot be observed. Alternatively, since self-excited oscillation at a constant frequency does not occur, thereby making it difficult to perform accurate gain adjustment, a problem may be caused if the amplitude of the tension deviation Te, that is, an amplitude of the tension detection value Tfb is too small.

With respect to the necessity described above, according to the present embodiment, so long as the tension-amplitude set value Tem is set, there is no possibility that an operator performs inappropriate setting of the additional-value amplitude D of the additional value in adjustment Vd to cause a problem, and thereby to make setting of the additional-value amplitude D again. Accordingly, the gain of the tension-control calculation unit 224 can be set to an appropriate value more simply in a shorter time.

Furthermore, the initial value of the additional-value amplitude D set by the amplitude determination unit 225*c* is set to a sufficiently small value. Therefore, when the application is made to before starting a conveyance operation between rollers at the time of startup as described above, similarly to the apparatus 200 for controlling conveyance between rollers according to the second embodiment, tension of the conveyed material 11 between the rollers gradually increases from a state where the conveyed material 11 may be loose with tension being zero, thereby enabling to perform an operation before a certain tension is given initially, which is difficult to be anticipated, stably as much as possible.

In the above descriptions, the apparatus 300 for controlling conveyance between rollers is applied at or from the time of startup before starting the conveyance operation between rollers for the conveyed material 11. However, if the tension is in a generally constant state during conveyance of the conveyed material 11, the apparatus 300 can be applied even during conveyance of the conveyed material 11 at an arbitrary conveyance speed. In this case, at a time point when the adjustment execution command Rt becomes ON, the tension detection value Tfb already has a value close to the tension command Tr. Therefore, the tension deviation Te can start minute oscillation immediately after the adjustment execution command Rt becomes ON.

The apparatus 300 for controlling conveyance between rollers according to the present embodiment operates in a manner as described above, and so even in a case where the gain of the tension-control calculation unit 224 has not been set at all before starting a conveyance operation between rollers at the time of initial startup, and even during the conveyance operation, the gain of the tension-control calculation unit 224 can be sec to an appropriate value in a short time, regardless of a situation of presetting the control gain of the tension-control calculation unit 224, without inconvenience of trial and error and without requiring knowledge based on experiences. Accordingly, the apparatus for controlling conveyance between rollers can be acquired, with which a user can easily realize control of conveying the conveyed material 11 between rollers while maintaining the tension at a desired value.

As described above, according to the apparatus 300 for controlling conveyance between rollers of the present embodiment, an amplitude of a tension control amount can be set to a preset magnitude, and the behavior thereof at the time of starting the adjustment is stabilized.

Fourth Embodiment

The apparatus 200 for controlling conveyance between rollers according to the second embodiment automatically performs adjustment of the gain of the tension-control calculation unit 124 before starting a conveyance operation between rollers at the time of initial startup, wherein the synchronous-speed-command generation unit 123 outputs the tension-shaft reference speed command Vr0 and the speed-shaft speed command Vr2 set as zero. However, there is a case where another configuration may be more effective in which the synchronous-speed-command generation unit outputs a value unequal to zero, as an operation at the time of the same initial startup.

Figure 8:
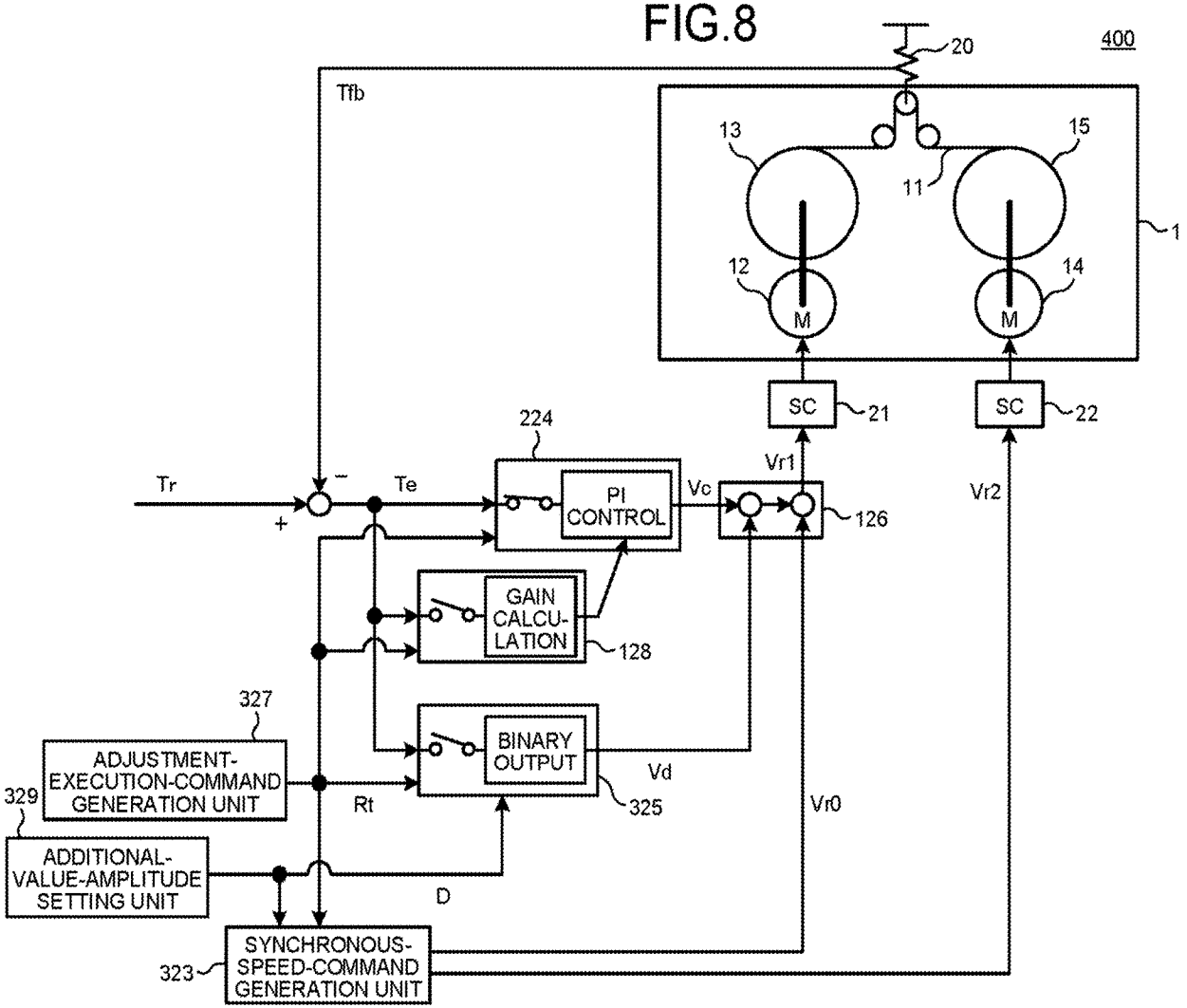
FIG. 8 is a block diagram illustrating a configuration of an apparatus for controlling conveyance between rollers according to a fourth embodiment of the present invention.

FIG. 8 is a block diagram illustrating a configuration of an apparatus 400 for controlling conveyance between rollers according to a fourth embodiment of the present invention. The same reference signs as those of FIGS. 1 and 3 refer to the same parts as those in the first or second embodiment, and explanations thereof will be omitted.

An adjustment-execution-command generation unit 327 generates the adjustment execution command Rt that is a signal indicating ON or OFF based on an operation from outside, similarly to the adjustment-execution-command generation unit 127 of the second embodiment. The apparatus 400 for controlling conveyance between rollers according to the present embodiment performs adjustment of the tension-control calculation unit 224 before starting a conveyance operation between rollers at the time of initial startup. Accordingly, the apparatus 400 changes the adjustment execution command Rt to ON, after having confirmed that the tension-shaft reference speed command Vr0 and the speed-shaft speed command Vr2 outputted by a synchronous-speed-command generation unit 323 are both zero.

An additional-value-amplitude setting unit 329 is caused to receive the additional-value amplitude D to be used in a binary output unit 335 as an input from outside.

The binary output unit 325 receives the adjustment execution command Rt and the additional-value amplitude D as inputs, and outputs a signal having an amplitude whose magnitude is the additional-value amplitude D preset based on the tension deviation Te, and having a positive or negative sign determined based on the tension deviation Te, that is, a value obtained by selecting one of two values of +D and −D according to the sign of the tension deviation Te, as the additional value in adjustment Vd.

Next, the synchronous-speed-command generation unit 323 receives the adjustment execution command Rt and the additional-value amplitude D as inputs, and outputs the tension-shaft reference speed command Vr0 and the speed-shaft speed command Vr2 based on the adjustment execution command Rt. During an OFF period before the adjustment execution command Rt becomes ON at the time of initial startup, the synchronous-speed-command generation unit 323 outputs both the tension-shaft reference speed command Vr0 and the speed-shaft speed command Vr2 as zero.

Subsequently, when the adjustment execution command Rt becomes ON, the synchronous-speed-command generation unit 323 outputs magnitudes of the tension-shaft reference speed command Vr0 and the speed-shaft speed command Vr1 as an offset value D2 determined based on the additional-value amplitude D, only during an automatic adjustment period during which the adjustment execution command Rt is ON. The offset value D2 is set as a value slightly larger than the additional-value amplitude D.

That is, the offset value D2 is determined as a value obtained by multiplying the additional-value amplitude D by a preset constant within a range roughly from one to five times the additional-value amplitude D. When the adjustment execution command Rt is changed to OFF, the synchronous-speed-command generation unit 323 changes the tension-shaft reference speed command Vr0 and the speed-shaft speed command Vr1 to zero again.

Figure 9:
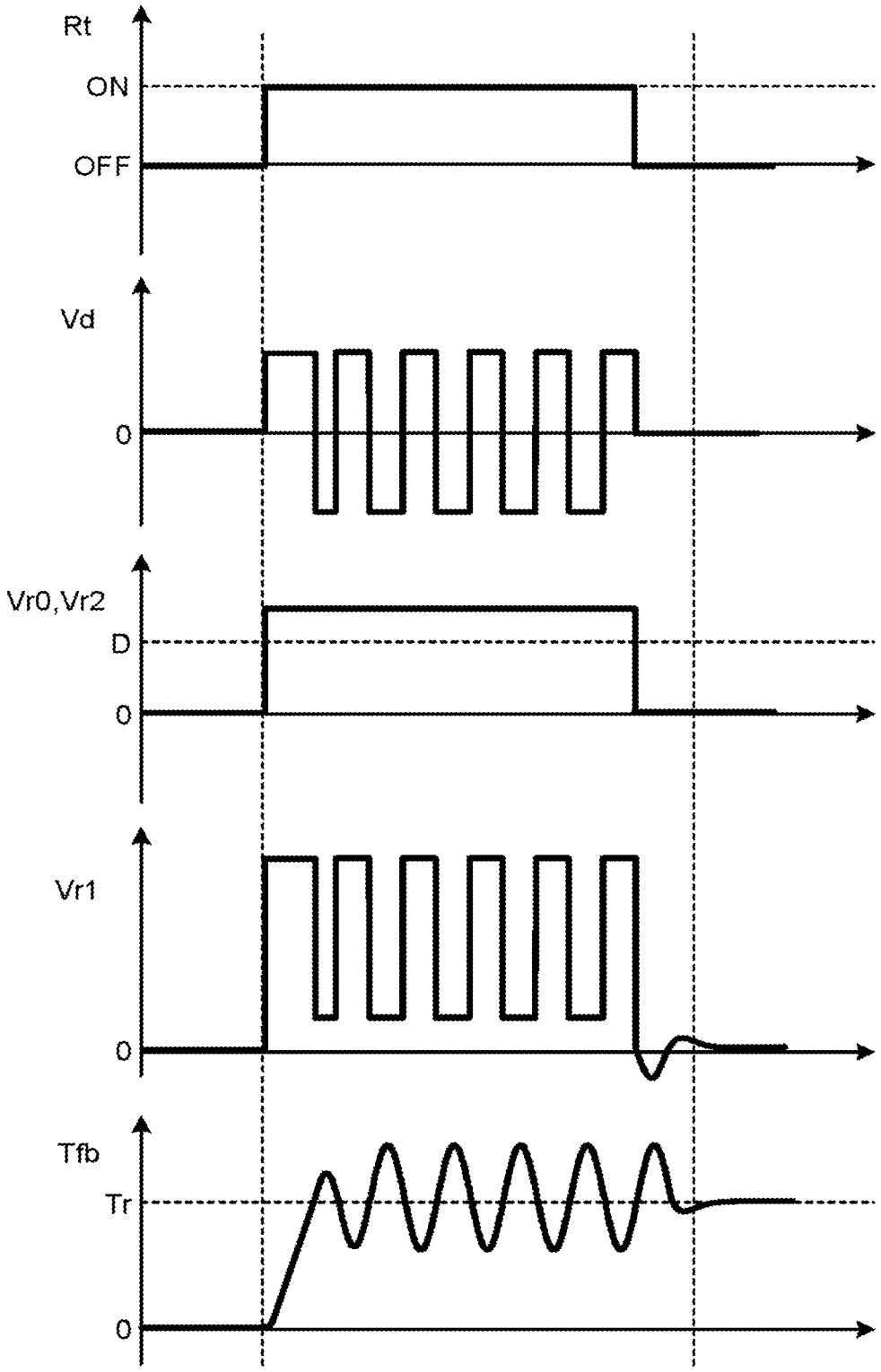
FIG. 9 is a time response graph illustrating the behavior of the apparatus for controlling conveyance between rollers according to the fourth embodiment of the present invention.

The behavior of the apparatus 400 for controlling conveyance between rollers having the above operation is described with reference to FIG. 9. FIG. 9 is a time response graph illustrating the behavior of the apparatus 400 for controlling conveyance between rollers according to the fourth embodiment of the present invention. The present embodiment is directed to a case where before the adjustment execution command Rt becomes ON, the tension-shaft reference speed command Vr0 and the tension-shaft speed command Vr1 are both set to zero. Further, the tension-control correction value Vc outputted by the tension-control calculation unit 224 is also zero. As a result, the tension-shaft speed command Vr1 is zero. Because the present embodiment brings the operation into practice at the time of startup before starting a conveyance operation between rollers, the tension detection value Tfb is also zero.

Subsequently, when the adjustment execution command Rt becomes ON, the magnitudes of the tension-shaft reference speed command Vr0 and the speed-shaft speed command Vr1 are outputted as the offset value D2 determined based on the additional-value amplitude D, only in the period during which the adjustment execution command Rt is ON.

Next, when the adjustment execution command Rt becomes ON, the synchronous speed command generation unit 323 makes the magnitude of the tension-shaft reference speed command Vr0 and the speed-shaft speed command Vr2 to have a value larger than the additional-value amplitude D, on the basis of the aforementioned operation of the synchronous-speed-command generation unit 323. Further, the additional value in adjustment Vd takes a value of +D or −D according to the operation described above. As a result, the tension-shaft speed command Vr1 has a positive value at all times for the duration of the adjustment execution command Rt being ON. In that duration, the tension detection value Tfb oscillates around the tension command Tr at a constant frequency, as with the first, or second embodiment.

Effects of making configuration in a manner described above are now described. In the conveyance mechanism 1 between rollers, gears or the like may be assembled so as to convey the conveyed material 11 only in one direction, in some cases. Further, as in the second embodiment, when the tension-shaft speed command Vr1 oscillates around zero, friction may change significantly according to the sign of the speed and/or a significant influence of backlash of the gear may be caused. In this case, by configuring the synchronous-speed-command generation unit 323 as described above, the tension-shaft speed command Vr1 basically takes a positive value at all times, and thus the problem described above does not occur.

Furthermore, the synchronous-speed-command generation unit 323 has an input of the additional-value amplitude D used for amplitude setting in the binary output unit 325, as described above, and sets the offset value D2 as a value equal to or slightly larger than the additional-value amplitude D. Therefore, the gain of the tension-control calculation unit 224 can be set by a stable motion of the conveyance mechanism 1 between rollers, without setting the tension-shaft speed command Vr1 and the speed-shaft speed command Vr2 to a value unnecessarily large, and without causing velocity inversion, only by the movement at a low speed.

Because the apparatus for controlling conveyance between rollers according to the present embodiment operates in a manner as described above, even in a case where the gain of the tension-control calculation unit 224 has not been set at ail before starting a conveyance operation between rollers at the time of initial startup, the gain of the tension-control calculation unit 224 can be set to an appropriate value in a short time, regardless of a situation of presetting the control gain of the tension-control calculation unit 224, without inconvenience of trial and error and without requiring knowledge based on experiences. Accordingly, it is possible to get the apparatus for controlling conveyance between rollers can be acquired, with which a user can easily realize control of conveying the conveyed material 11 between rollers while maintaining the tension at a desired value.

As described above, according to the apparatus 400 for controlling conveyance between rollers of the fourth embodiment, the gain of the tension-control calculation unit 224 can be set to an appropriate value in a short time, regardless of a situation of presetting the control gain of the tension-control calculation unit 224, without causing any trouble even if there is friction or backlash, and without performing the conveyance motion between rollers beforehand.

Furthermore, the invention of the present application is not limited to the above embodiments, and when the present invention is carried out, the invention can be variously modified without departing from the scope thereof. In the above embodiments, inventions on various stages are included, and various inventions can be extracted by appropriately combining a plurality of constituent requirements disclosed herein. For example, even when some constituent requirements are omitted from all constituent requirements described in the embodiments, as far as the problems mentioned in the section of Solution to Problem can be solved and effects mentioned in the section of Advantageous Effects of Invention are obtained, the configuration in which some constituent requirements have been omitted can be extracted as an invention. In addition, constituent elements mentioned in different embodiments can be appropriately combined.

INDUSTRIAL APPLICABILITY

As described above, the apparatus for controlling conveyance between rollers according to the present invention is useful for an apparatus for controlling conveyance between rollers that conveys a belt-like or linear conveyed material which is made from a material such as metal, resin or paper, between rollers driven by a plurality of motors, respectively while holding tension therebetween. Particularly, in conveyance between rollers, it is suitable for an apparatus for controlling conveyance between rollers, that can set a gain of a tension-control calculation unit to an appropriate value in a short time under various conditions such as conveyance speeds, regardless of a situation of presetting the control gain of the tension-control calculation unit, without inconvenience of trial and error and without requiring knowledge based on experiences.

REFERENCE SIGNS LIST

1 conveyance mechanism between rollers, 11 conveyed material, 12 tension shaft motor, 13 tension shaft roller, 14 speed shaft motor, 15 speed shaft roller, 20 tension control-amount detector, 21 tension-shaft speed controller, 22 speed-shaft speed controller, 23, 123, 223, 323 synchronous-speed-command generation unit, 24, 124, 224 tension-control calculation unit, 25, 125, 225, 325 binary output unit, 26, 126 tension-shaft speed-command generation unit, 27, 127, 227, 327 adjustment-execution-command generation unit,

28, 128, 228 gain calculation unit, 100, 200, 300, 400 apparatus for controlling conveyance between rollers, 229 output-amplitude setting unit, 329 additional-value-amplitude setting unit, 225*a* output-amplitude measurement unit, 225*b* output-amplitude comparison unit, 225*c* amplitude determination unit, 225*d* binary-output determination unit.

The invention claimed is:

1. An apparatus for controlling conveyance between rollers that conveys a conveyed material using a speed shaft roller driven by a speed shaft motor and a tension shaft roller driven by a tension shaft motor while applying tension to the conveyed material between the speed shaft roller and the tension shaft roller, the apparatus comprising:

a tension control-amount detector to detect and output a tension control amount that is a variable that changes according to tension fluctuation of the conveyed material and is controlled so as to become a desired value;

a speed-shaft speed controller to execute control on the speed shaft motor so that a speed at which the speed shaft roller conveys the conveyed material is equal to a speed of a speed-shaft speed command;

a tension-shaft speed controller to execute control on the tension shaft motor so that a speed at which the tension shaft roller conveys the conveyed material is equal to a speed of a tension-shaft speed command;

a synchronous-speed-command generation unit to generate the speed-shaft speed command and a tension-shaft reference speed command that is to be a reference of the tension-shaft speed command in synchronization with each other in change;

a tension-control calculation unit to output a tension-control correction value based on proportional compensation obtained by multiplying a tension control deviation that is a deviation between a set tension-control command value and the tension control amount, by a proportional gain, and integral compensation obtained by integration with multiplying the tension control deviation by an integral gain;

an adjustment-execution-command generation unit to output an adjustment execution command that becomes ON during a preset automatic adjustment period, based on an instruction input from outside;

a binary output unit to output an additional value in adjustment having an amplitude whose magnitude is a preset additional-value amplitude and having a positive or negative sign determined based on the tension control deviation, during the automatic adjustment period;

a tension-shaft speed-command generation unit to receive the tension-shaft reference speed command, the tension-control correction value and the additional value in adjustment, and output the tension-shaft speed command based on addition or selection thereof; and a gain calculation unit to calculate the proportional gain and the integral gain based on a measurement result of an oscillation period and an amplitude of the tension control deviation, during the automatic adjustment period, wherein the adjustment-execution-command generation unit outputs an adjustment execution command being ON, when both or either one of the speed-shaft speed command and the tension-shaft reference speed command of the synchronous-speed-command generation unit is zero, and the binary output unit changes the additional-value amplitude with passage of time and sets the additional-value amplitude so that the additional-value amplitude in a period from a time point when an output of the adjustment-execution-command generation unit becomes ON until a time point when a sign of the tension control deviation first changes is smaller than an additional-value amplitude after the time point when the sign of the tension control deviation first changes.

2. The apparatus for controlling conveyance between rollers according to claim 1, further comprising an output-amplitude setting unit to receive a tension-amplitude set value from outside, wherein the binary output unit includes:

an output-amplitude measurement unit to calculate and output a tension deviation amplitude that is an amplitude of the tension control deviation;

an output-amplitude comparison unit to compare magnitudes of the tension deviation amplitude and the tension-amplitude set value with each other;

an amplitude determination unit to update and output the additional-value amplitude so as to increase from an initial value while the tension deviation amplitude is smaller than the tension-amplitude set value, based on an output of the output-amplitude comparison unit; and a binary-output determination unit to output a value obtained by selecting one of two values being a positive value and a negative value having a magnitude of the additional-value amplitude, based on the tension control deviation, as the additional value in adjustment.

3. An apparatus for controlling conveyance between rollers that conveys a conveyed material using a speed shaft roller driven by a speed shaft motor and a tension shaft roller driven by a tension shaft motor while applying tension to the conveyed material between the speed shaft roller and the tension shaft roller, the apparatus comprising:

a tension control-amount detector to detect and output a tension control amount that is a variable that changes according to tension fluctuation of the conveyed material and is controlled so as to become a desired value;

a speed-shaft speed controller to execute control on the speed shaft motor so that a speed at which the speed shaft roller conveys the conveyed material is equal to a speed of a speed-shaft speed command;

a tension-shaft speed controller to execute control on the tension shaft motor so that a speed at which the tension shaft roller conveys the conveyed material is equal to a speed of a tension-shaft speed command;

a synchronous-speed-command generation unit to generate the speed-shaft speed command and a tension-shaft reference speed command that is to be a reference of the tension-shaft speed command in synchronization with each other in change;

a tension-control calculation unit to output a tension-control correction value based on proportional compensation obtained by multiplying a tension control deviation that is a deviation between a set tension-control command value and the tension control amount, by a proportional gain, and integral compensation obtained by integration with multiplying the tension control deviation by an integral gain;

an adjustment-execution-command generation unit to output an adjustment execution command that becomes ON during a preset automatic adjustment period, based on an instruction input from outside;

a binary output unit to output an additional value in adjustment having an amplitude whose magnitude is a preset additional-value amplitude and having a positive or negative sign determined based on the tension control deviation, during the automatic adjustment period;

a tension-shaft speed-command generation unit to receive the tension-shaft reference speed command, the tension-control correction value and the additional value in adjustment, and output the tension-shaft speed command based on addition or selection thereof;

a gain calculation unit to calculate the proportional gain and the integral gain based on a measurement result of an oscillation period and an amplitude of the tension control deviation, during the automatic adjustment period; and an additional-value-amplitude setting unit to receive the additional-value amplitude from outside, wherein the synchronous-speed-command generation unit outputs the speed-shaft speed command and the tension-shaft reference speed command as zero, at a time of initial startup and in an OFF period until the adjustment execution command is changed to ON, and immediately after the adjustment execution command is changed from ON to OFF, and outputs the tension-shaft reference speed command and the speed-shaft speed command having a magnitude equal to or larger than the additional-value amplitude during the automatic adjustment period.

* * * * *